US007168849B2

(12) United States Patent
Adams

(10) Patent No.: US 7,168,849 B2
(45) Date of Patent: Jan. 30, 2007

(54) AGITATION APPARATUS AND METHOD FOR DRY SOLIDS ADDITION TO FLUID

(75) Inventor: Daniel M. Adams, Rochester, NY (US)

(73) Assignee: SPX Corporation, Charlotte, NC (US)

( * ) Notice: Subject to any disclaimer, the term of this patent is extended or adjusted under 35 U.S.C. 154(b) by 27 days.

(21) Appl. No.: 11/049,928

(22) Filed: Feb. 4, 2005

(65) Prior Publication Data

US 2006/0176771 A1 Aug. 10, 2006

(51) Int. Cl.
*B01F 7/22* (2006.01)
*B01F 7/26* (2006.01)

(52) U.S. Cl. ..... 366/270; 366/291; 366/307; 366/315

(58) Field of Classification Search .. 366/330.1–330.7, 366/96–98, 262–265, 270, 290–291, 327.3, 366/64–67, 307
See application file for complete search history.

(56) References Cited

U.S. PATENT DOCUMENTS 1,584,126 A * 5/1926 North ..... 426/388
2,845,936 A * 8/1958 Boynton et al. ..... 134/60

(Continued)

FOREIGN PATENT DOCUMENTS

DE 3939984 A1 * 6/1991

(Continued)

OTHER PUBLICATIONS

"Lightnin Fluid Mixers—Fluid agitators, agitators, industrial mixers and equipment", (Frequently Asked Questions), http://www.lightnin-mixers.com/news/cs_fags.asp, pp. 1-6.

(Continued)

*Primary Examiner*—Charles E. Cooley
(74) *Attorney, Agent, or Firm*—Baker & Hostetler LLP

(57) ABSTRACT

An agitation system for producing a slurry, mixture, or solution from addition of dry solids to a liquid is provided. A first tank has a first longitudinal axis, a static liquid level, a dynamic liquid level, and a holdup. A solid inlet is configured to feed dry solids into the first tank. A first drive shaft is disposed in the first tank generally along the first longitudinal axis and a first impeller is attached to the first drive shaft at a first location. The first impeller is configured to pump material in a generally upward direction. A second tank having a second longitudinal axis is in fluid communication with the first tank. A second drive shaft is disposed in the second tank generally along the second longitudinal axis and a second impeller is attached to the second drive shaft at a first location and a third impeller is attached to the second drive shaft at a second location. The second impeller is configured to direct flow toward the third impeller, and the third impeller is configured to direct flow toward the second impeller. A pumper impeller is attached to the second drive shaft so that the second impeller is in between the pumper impeller and the third impeller and a separator disc is attached to the second drive shaft in between the pumper impeller and the second impeller.

22 Claims, 4 Drawing Sheets

U.S. PATENT DOCUMENTS

| | | | | | |
|---|---|---|---|---|---|
| 4,021,021 | A | * | 5/1977 | Hall et al. | 366/156.1 |
| 4,096,586 | A | * | 6/1978 | Badertscher et al. | 366/136 |
| 4,468,130 | A | | 8/1984 | Weetman | |
| 4,610,547 | A | * | 9/1986 | Bennett et al. | 366/270 |
| 4,671,665 | A | | 6/1987 | McIntire | |
| 4,941,752 | A | | 7/1990 | Yant et al. | |
| 4,955,723 | A | * | 9/1990 | Schneider | 366/136 |
| 5,046,856 | A | * | 9/1991 | McIntire | 366/291 |
| 5,195,824 | A | * | 3/1993 | Stromberg et al. | 366/131 |
| 5,240,327 | A | * | 8/1993 | Nyman et al. | 366/302 |
| 5,580,168 | A | * | 12/1996 | Alireza et al. | 366/153.1 |
| 5,782,556 | A | * | 7/1998 | Chu | 366/155.1 |
| 5,951,161 | A | * | 9/1999 | Blagg | 366/152.6 |
| 6,132,080 | A | * | 10/2000 | Gurth | |
| 6,158,722 | A | | 12/2000 | Gigas | |
| 6,250,796 | B1 | * | 6/2001 | Huang | 366/270 |
| 2004/0188334 | A1 | * | 9/2004 | McWhirter et al. | |
| 2006/0176771 | A1 | * | 8/2006 | Adams | |

FOREIGN PATENT DOCUMENTS

| | | | |
|---|---|---|---|
| JP | 9-309725 | * | 12/1997 |

OTHER PUBLICATIONS

"A320: Lightnin's Fluidfoil Data and Information at Post Mixing" (Post Mixing Optimization and Solutions), http://www.postmixing.com/mixing%20forum/impellers/a320.htm, Apr. 10, 2004, pp. 1-2.
"Lightnin" (Mining & Minerals-Mineral Processing with Lightnin Mixers), "Attrition Scrubber", http://www.lightnin-mixers.com/new/attrition_scrubber.asp, p. 1.
"Attriton Scrubbers", www.westpromachinery.com, p. 1.

* cited by examiner

AGITATION APPARATUS AND METHOD FOR DRY SOLIDS ADDITION TO FLUID

FIELD OF THE INVENTION

The present invention relates generally to the field of mixing. More particularly, the present invention relates to an agitation system and method for the addition of dry solids to fluid.

BACKGROUND OF THE INVENTION

Mixing systems are used in a variety of industrial processes to add dry solids to liquids during processing. For example, wetting out solids is sometimes required during chemical processing, food processing or mineral processing. An efficient and effective addition of dry solids to a liquid rapidly mixes the solids and liquid into a uniform mixture, slurry, or solution.

One problem that is often encountered during mixing of dry solids with liquids is clumping of solids in the mixture. These clumps are dry solids that have not been wetted by the liquid. This clumping of solids is oftentimes referred to in the art as "fish eyes." Removal of these clumps, or wetting out hard to wet solids, is important in maintaining a uniform mixture and is oftentimes difficult. Clumping is especially pronounced in general when the solid concentration in the mixture is relatively high. The physical characteristics of certain solids also lead to a relatively high degree of clumping in some situations.

The speed of producing a uniform mixture is important in maintaining process efficiency. An efficient process will rapidly mix a large quantity of solids with a liquid using cost-effective equipment. An efficient process often reduces capital costs and variable costs, which enhances the bottom line.

Accordingly, it is desirable to provide a method and apparatus that is capable of rapidly and efficiently mixing dry solids to liquids. It is further desirable to provide a method and apparatus that is capable of operating under a wide variety of conditions, such as low solids concentrations and high solids concentration. In addition, it is further desirable to provide a method and apparatus that is capable of producing a uniform mixture, slurry, or solution.

SUMMARY OF THE INVENTION

The foregoing needs are met, to a great extent, by the present invention, wherein in one aspect an apparatus is provided that in some embodiments rapidly and efficiently mixes dry solids to liquids under a wide range of operating conditions into a uniform mixture, slurry, or solution.

In accordance with one embodiment of the present invention, an agitation system for producing a slurry, mixture, or solution from addition of dry solids to a liquid is provided. The agitation system includes a first tank that has a first longitudinal axis, a static liquid level, a dynamic liquid level, and a holdup, where the difference between the dynamic liquid level and the static liquid level defines the height of the holdup.

In addition, a solid inlet feeds dry solids into the first tank, and a first drive shaft is disposed in the first tank, generally along the first longitudinal axis. A first impeller is attached to the first drive shaft at a first location where the first impeller pumps material in a generally upwards direction. A second tank having a second longitudinal axis is in fluid communication with the first tank. A second drive shaft is disposed in the second tank generally along the second longitudinal axis. A second impeller is attached to the second drive shaft at a first location, and a third impeller is attached to the second drive shaft at a second location. The second impeller directs flow toward the third impeller, and the third impeller directs flow toward the second impeller.

In accordance with another embodiment of the present invention, a method for addition of dry solids to liquids is provided. The method includes passing dry solids and liquids into a first tank, where the first tank includes at least a first up pumping impeller. The method further includes wetting the dry solids with the liquids in the first tank to form a first mixture, slurry or solution. The method further includes passing the first mixture, slurry or solution into a second tank, where the second tank includes a second impeller and a third impeller, where the second impeller directs flow towards the third impeller, and the third impeller directs flow towards the second impeller. The method further includes generating a high shear zone in the second tank and passing the first mixture in the second tank through the high shear zone to form a second mixture, slurry or solution.

In accordance with still another embodiment of the present invention, an agitation system for producing a slurry, mixture or solution from addition of dry solids to a liquid is provided. The agitation system includes a means for passing dry solids and liquids into a first tank, a means for generating an up-pumping flow pattern in the first tank, a means for wetting the dry solids with the liquids in the first tank to form a first mixture, slurry or solution, a means for passing the first mixture, slurry or solution into a second tank, a means for generating a high shear zone in the second tank, and a means for passing the first mixture, slurry or solution through the high shear zone to form a second mixture, slurry or solution.

There has thus been outlined, rather broadly, certain embodiments of the invention in order that the detailed description herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
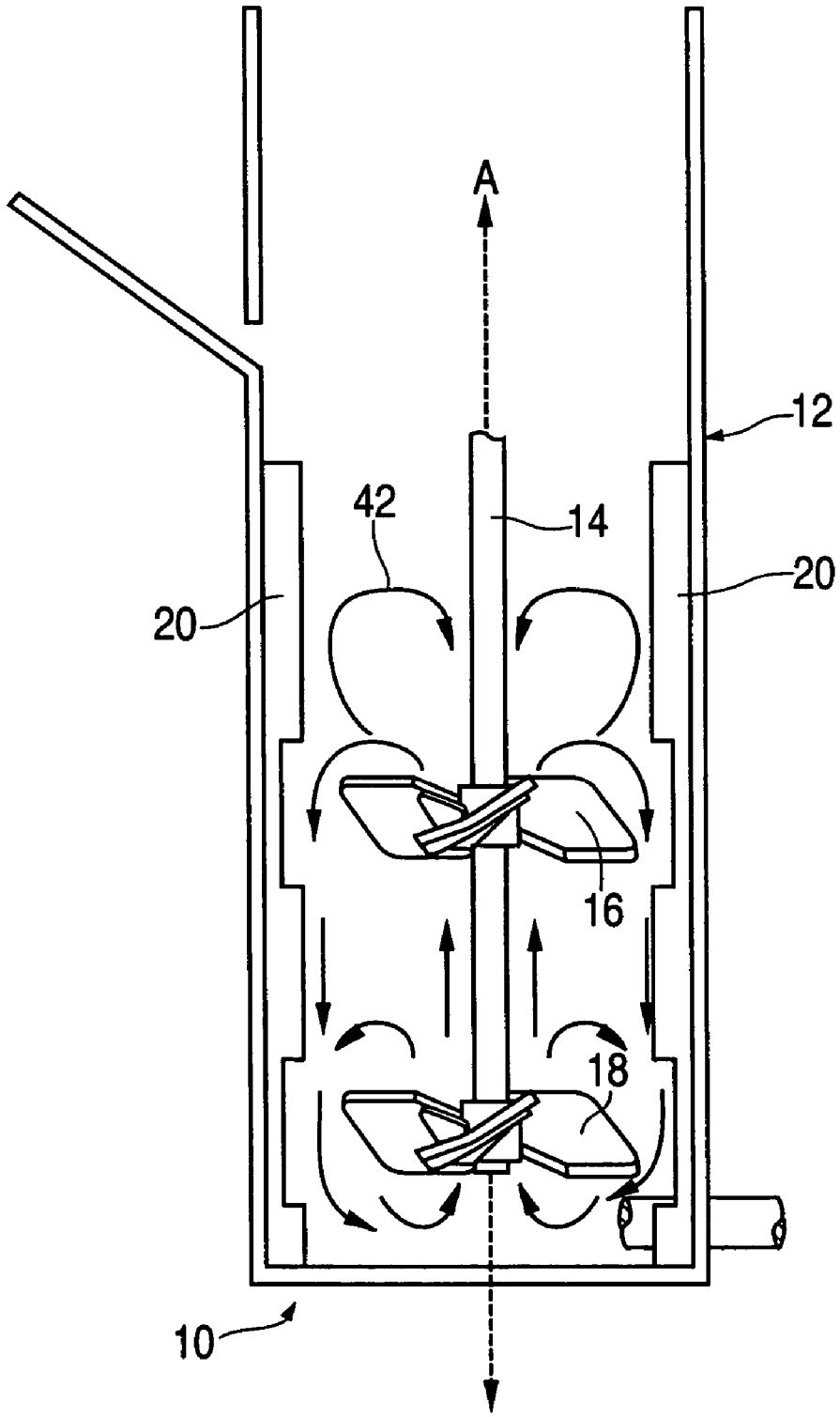
FIG. 1 is a cross-sectional view illustrating a mixer according to an embodiment of the invention.

The invention will now be described with reference to the drawing figures, in which like reference numerals refer to like parts throughout. An embodiment in accordance with the present invention provides an apparatus and method for mixing dry solids to liquids. The apparatus includes an up-pumping mixer that provides the initial mixing of the dry solids to liquids and an attrition scrubber that removes clumping from the mixture. By using both a mixer and attrition scrubber, dry solids can be rapidly added to liquids to form a uniform mixture.

An embodiment of the present inventive apparatus and method is illustrated in FIG. 1. FIG. 1 illustrates an embodiment of a mixer 10 having a tank 12 with a longitudinal axis A. The tank 12 can be manufactured in a variety of shapes, including but not limited to a cylindrical, rectangular, square or octagonal shape, from a variety of materials, including steel, stainless steel, concrete, plastics, metals or ceramics. In addition, the tank 12 can be provided with a durable rubber coating if desired. A driveshaft 14 is disposed in the tank 12 along the longitudinal axis A. Attached to the driveshaft 14 are two axial flow impellers 16 and 18 in series, a top impeller 16 and a bottom impeller 18. An example of an axial flow impeller 16 and 18 is the A340 impeller manufactured by Lightnin, located in Rochester, N.Y.

The radial impellers 16 and 18 may have geometries which employ three or four blades depending upon application. In the embodiments depicted, the impellers 16 and 18 technically up-pump the fluid; however, the impeller 16 also provides radial flow of fluid due its position in respect to the bottom impeller 18. In the embodiment depicted in FIG. 1, the radial impellers 16 and 18 depicted in FIG. 1. have three blades and are generally constructed from steel or stainless steel. The up-pumping impellers 16 and 18 can also be coated with a durable rubber coating when desired. When the up-pumping impellers 16 and 18 are operated under turbulent conditions, the flow the impellers 16 and 18 produce is axial. Factors influencing whether the flow will be turbulent or laminar, and, therefore, whether the flow will be axial or radial, respectively, include fluid viscosity and impeller 16 and 18 rotational velocity. In the case of a solid-liquid slurry that exhibits non-Newtonian fluid characteristics, prediction of flow patterns may be difficult. However, empirical observation of flow patterns can allow the operator to set process conditions, such as impeller 16 and 18 speed or slurry composition so axial flow is achieved when desired. Impeller 16 and 18 rotational speed is a function of both the impeller size and process requirements. In some embodiments of the invention, relatively large impellers 16 and 18 are operated at speeds up to approximately 60 revolutions per minute, while relatively small impellers 16 and 18 are operated at speeds up to approximately 350 revolutions per minute.

As illustrated in FIG. 1, baffles 20 can be disposed within the tank 12 to reduce the likelihood of swirl. Swirl is usually undesirable because it generally reduces the efficiency of the mixing process. Although many types of baffle 20 placements can be employed, some baffle 20 configurations include four baffles 20 placed approximately 90 degrees apart. The baffles 20 are generally aligned so that they project radially toward the center of the tank 12. However, the baffles 20 may also be configured in a slanted orientation. In addition, the baffles 20 may be offset from the tank wall 22 so that there is a gap between the tank wall 22 and the baffles 20.

Figure 2:
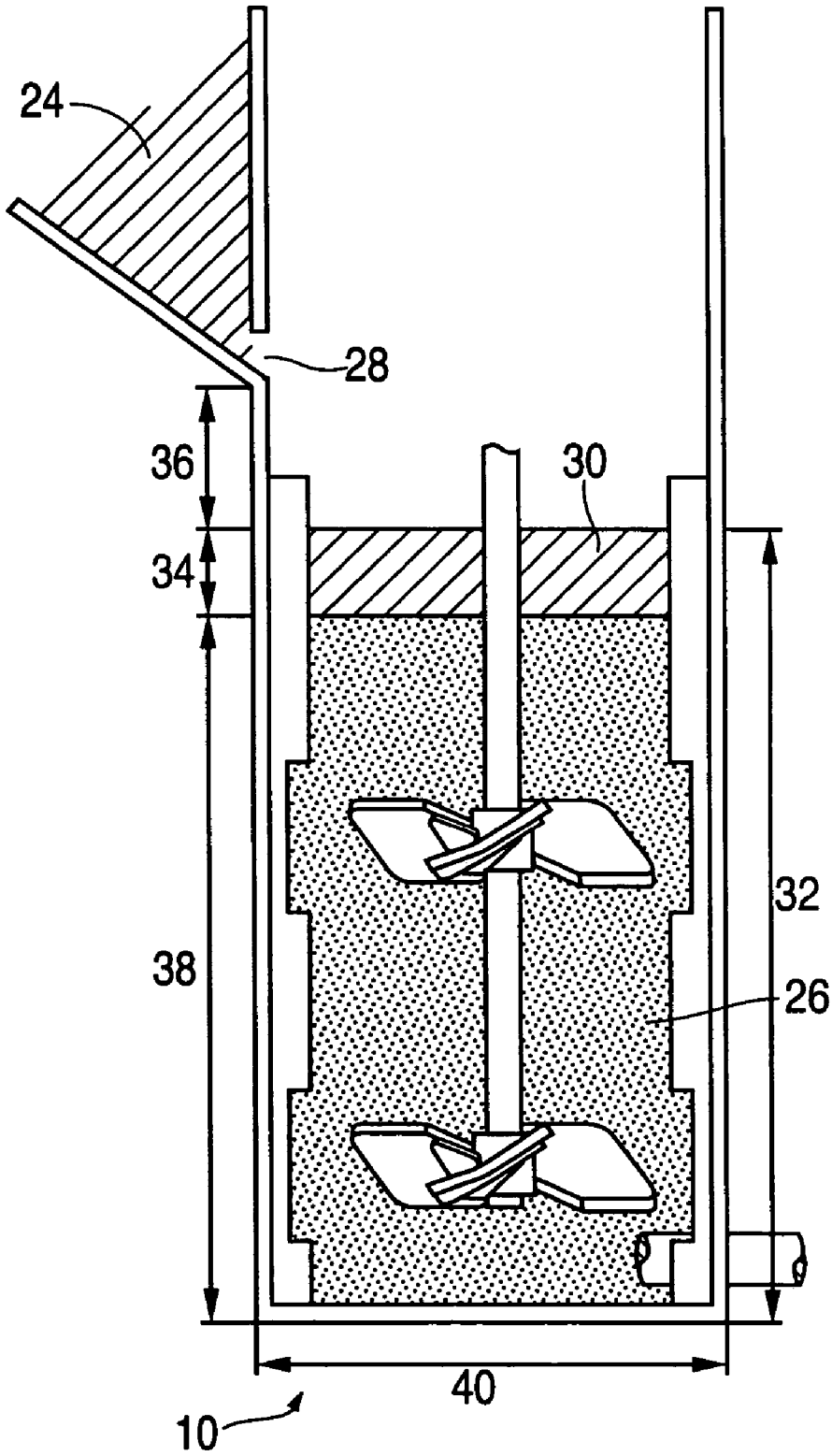
FIG. 2 is another cross-sectional view of a mixer according to an embodiment of the invention.

FIG. 2 illustrates an embodiment of the mixer 10 filled with dry solids 24 and a solid-liquid slurry 26. Dry solids 24 are introduced into the tank 12 through a solids inlet port 28. The tank 12 is filled with a slurry 26 and some holdup 30 that includes a mixture of solids, liquid and air. The solids inlet port 28 is located above the dynamic liquid level 32 by a height that is approximately twice the holdup height 34. In other words, the inlet port height 36 is twice the holdup height 34. Placing the inlet port 28 at a greater height above the dynamic liquid level 32 would also be suitable. The dynamic liquid level 32 includes the static liquid level 38 plus the holdup height 34. The static liquid level 38 is approximately 1.2 times the tank diameter 40. The positioning of the solids inlet port 28 at such a height is important in reducing the likelihood of plugging or clogging of the solids inlet port 28, via liquid contact, with dry solids 24 in the solids inlet port 28.

The general flow pattern 42 within the tank 12 under axial flow conditions is illustrated in FIG. 1. The bottom axial flow up-pumping impeller 18 discharges fluid in an upward axial direction toward the inlet side of the top impeller 16. The fluid is drawn into the top impeller 16 and discharged in a complex pattern. Fluid tends to be discharged in a direction from the top impeller 16. When the flow nears the tank 12 wall, the flow splits into two streams. A portion of the flow travels downward along the side of the tank 12 wall, and the other portion of the flow moves upward and inward in a generally circular path. This configuration of impellers 16 and 18 creates strong surface motion that is capable of rapidly drawing down floating solids. This stage in the agitation process rapidly wets out the solids with relatively low shear.

Figure 3:
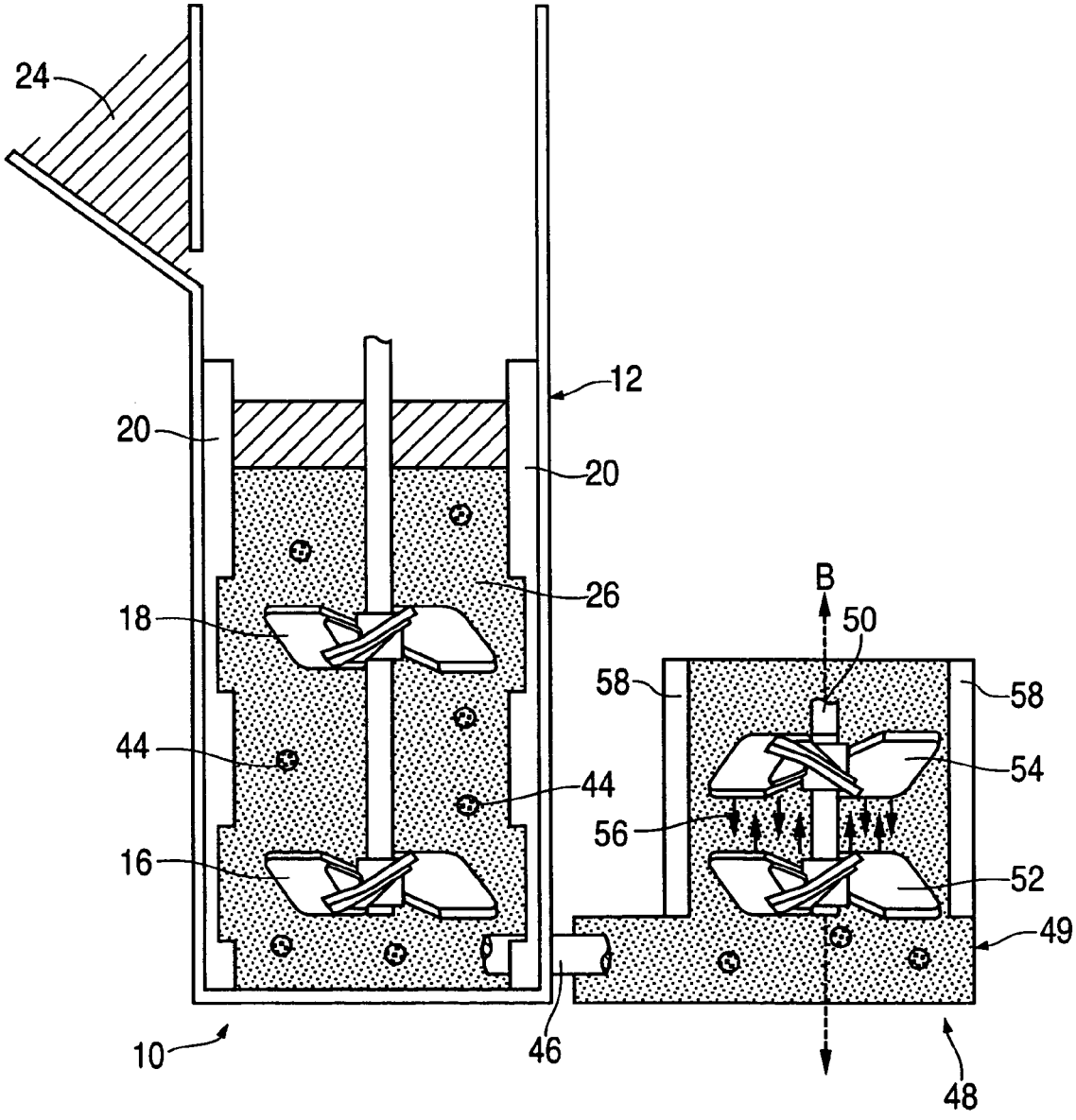
FIG. 3 is a cross-sectional view of an agitation system according to an embodiment of the invention.

As shown in FIG. 3, after the dry solids 24 are rapidly wetted out by the up-pumping mixer 10 to form a solid-liquid slurry 26, clumps 44 of unwetted dry solids 24 may remain in the solid-liquid slurry 26 because of the relatively low shear conditions of the up-pumping mixer 10. The solid-liquid slurry 26 and any clumps 44 in the slurry 26 are passed from the up-pumping mixer 10 to an attrition scrubber 48 that is configured to smooth out the solid-liquid slurry 26 by removing the clumps 44, via underflow. The aforementioned underflow from the mixer 10 to the attrition scrubber 48 may occur, for example, through a pipe 46 located at the bottom or near the bottom of the mixer tank 12, as illustrated in FIG. 3. Alternatively, the underflow may occur via a discharge orifice. The discharge orifice can be of any shape or geometry, for example, rectangular in cross-section.

The attrition scrubber illustrated in FIG. 3 includes a tank 49 having a longitudinal axis B. The tank 49 can be manufactured in a variety of shapes, including but, not limited to, a cylindrical, rectangular, square or octagonal shape, from a variety of materials, including steel, stainless steel, concrete, plastics, metals or ceramics. In addition, the tank 49 can be provided with a durable rubber coating if desired. A driveshaft 50 is disposed in the tank 49 along the longitudinal axis B. Attached to the driveshaft 50 are an axial flow up-pumping impeller 52 and an axial flow down-pumping impeller 54 in series, where the up-pumping impeller 52 is upstream of the down-pumping impeller 54. An example of an axial flow up-pumping impeller 52 is the A340 impeller manufactured by Lightnin, located in Rochester, N.Y. An example of an axial flow down-pumping impeller 54 is the A320 impeller also manufactured by Lightnin, located in Rochester, N.Y.

The positioning of the upstream up-pumping impeller 52 in series with the down-pumping impeller 54 results in a high shear zone between the up-pumping impeller 52 and the down-pumping impeller 54. Flow from the up-pumping impeller 52 is directed upward toward the down-pumping impeller 54, and conversely, flow from the down-pumping impeller 54 is directed downward toward the up-pumping impeller 52. The opposing flows 56 generate a high shear zone between the up-pumping impeller 52 and the down-pumping impeller 54 that is efficient in breaking up clumps 44 and wetting out the dry solids 24 in those clumps. After the solid-liquid slurry 26 passes through the attrition scrubber 48, clumps 44 are removed and a relatively uniform and consistent solid-liquid slurry 26 is produced.

The up-pumping impeller 52 utilized in the attrition scrubber 48, illustrated in FIG. 3, is substantially similar to the up-pumping impellers 16 and 18 utilized in the up-pumping mixer 10. One possible difference between the up-pumping impellers 16 and 18, used in the up-pumping mixer 10 and the up-pumping impeller 52 used in the attrition scrubber 48, is impeller size. Another possible difference is the rotational velocity. The size of the up-pumping impeller 52 and the rotational velocity used can be adjusted to fit process requirements.

The down-pumping impeller 54 is an up-pumping impeller 52 flipped upside down. Both the down-pumping impeller 54 and the up-pumping impeller 52 are generally fabricated from steel or stainless steel. Like the up-pumping impellers 16 and 18 used in the up-pumping mixer 10, the up-pumping impeller 52 and down-pumping impeller 54 used in the attrition scrubber 48 have three blades that can be coated with a durable rubber coating. Likewise, when the up-pumping impellers 52 and down-pumping impeller 54 are operated under turbulent conditions the flow the impellers 52 and 54 produce is axial.

In addition, the attrition scrubber 48 illustrated in FIG. 3 has baffles 58 disposed in the tank 49. The baffles 58 of the attrition scrubber 48, like the baffles 10 in the up-pumping mixer 10, reduce swirl which tends to increase the efficiency of the attrition scrubbing process.

Although the A340 up-pumping impeller and the A320 down-pumping impeller have been described the embodiments described above, other types of up-pumping impellers and down-pumping impellers may be used. For example, impellers with fewer or greater number of blades can be used instead. Different materials can be used to construct the impellers, such as fiber reinforced plastic, other metals or metal alloys, ceramics or plastic.

Likewise, the tank construction for the mixer 10 and attrition scrubber 48 can be customized to fit process requirements. The shapes can vary from cylindrical to rectangular to octagonal to any other suitable shape. Material of construction can vary from metal, metal alloys, concrete, glass, plastic or any other suitable material.

Although the embodiment described above comprises a single mixer 10 and a single attrition scrubber 48, multiple mixers 10 and/or multiple attrition scrubbers 48 may be used in a single process. For example, two attrition scrubbers 48 may be used in series following a single mixer 10 if clumping is not adequately removed following a single pass though one attrition scrubber 48. Alternatively, two mixers 10 can be used in parallel with one attrition scrubber 48, if the initial wetting out of the solids is holding up the process. In addition, it may be possible to scale up a process by adding an additional mixer 10 and/or attrition scrubber 48 to a preexisting process. By retaining existing equipment, capital cost savings may be realized. The flexibility and ability of the process to accommodate changes in process requirements are important in being able to quickly respond to changes in market demands.

Although the embodiment described above works particularly well when the solids concentration is between approximately 35 percent to 70 percent of the mixture, slurry, or solution, other solids concentrations can be used. More specifically, solids concentrations less than 35 percent or greater than 70 percent can be used.

Figure 4:
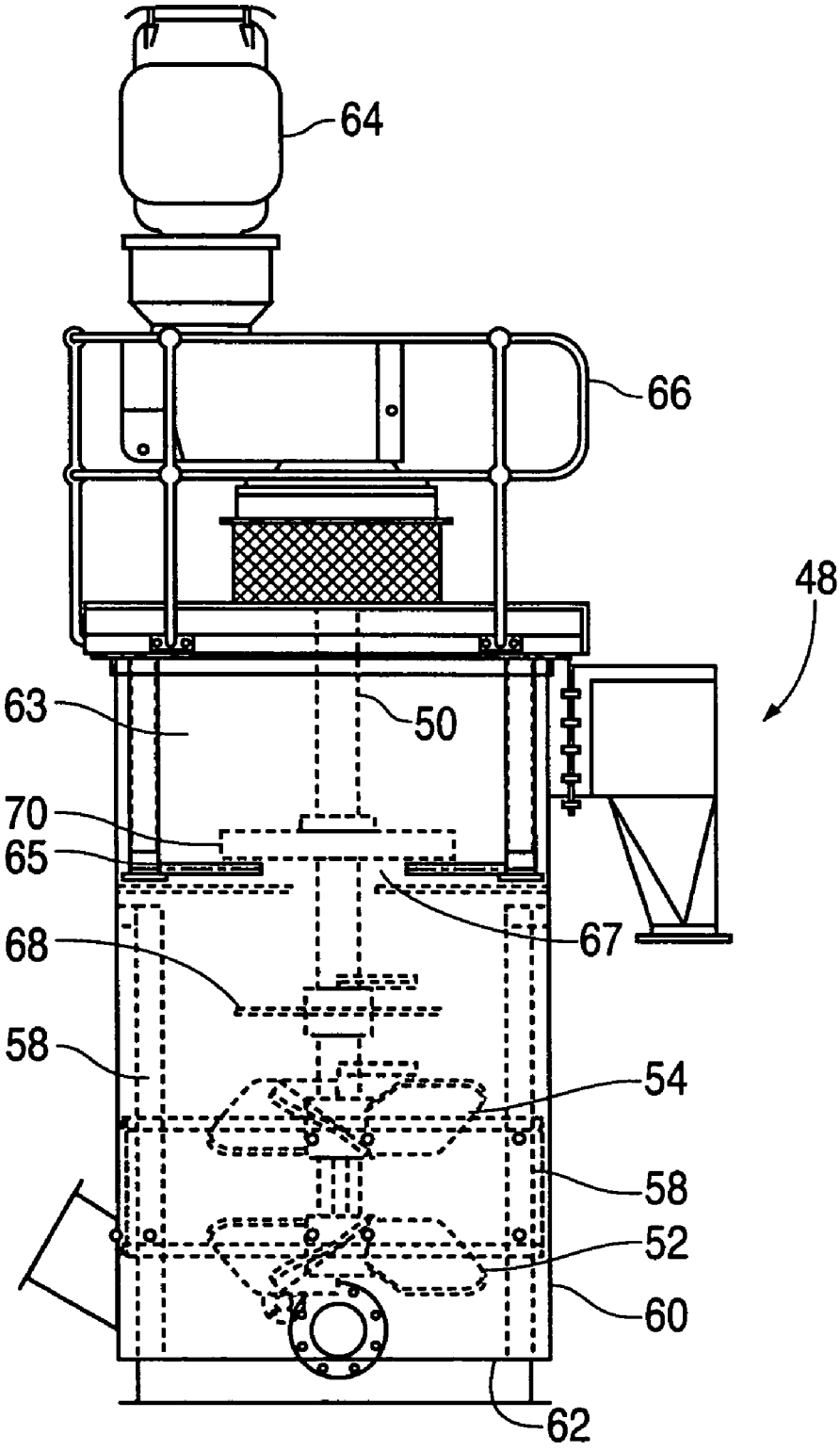
FIG. 4 is a detailed cross-sectional view of an attrition scrubber in accordance with an embodiment of the present invention.

Referring now to FIG. 4, a detailed cross-sectional view of the attrition scrubber 48, depicted in FIG. 3, is illustrated. As previously described in connection with the embodiment depicted in FIGS. 1–3, the attrition scrubber 48 includes a tank or mixing vessel 49 having a longitudinal axis B. The tank may have a variety of shapes or geometries, for example, cylindrical, as illustrated in FIG. 4, however, other geometries may include rectangular, square and octagonal shape. The tank 49 may be manufactured from a variety materials including steel, stainless steel, concrete, plastics, metals or ceramic.

In the embodiment depicted in FIG. 4, the tank 49 of the attrition scrubber 48 includes a cylindrical side wall 60 connected to a base 62. The attrition scrubber also includes a pump chamber, generally designated 63, that is connected to the tank 49, and is positioned vertically above the tank 49 along the longitudinal axis B. The pump chamber 63 and the tank 49 are separated by the false bottom 65 that has a flow path 67 which allows flow of the slurry from the tank 49 into the pump chamber 63.

The attrition scrubber 48 further includes a drive assembly or motor 64 mounted to a support frame 66 above the pump chamber 63 that drives or rotates the driveshaft 50. As illustrated in FIG. 4, the driveshaft 50 is disposed within the tank 49 and extends along the longitudinal axis B through the tank 49 and pump chamber 63. If desired, the tank may also be fitted with an interior rubber coating as previously mentioned.

The attrition scrubber 48 also includes first and second axial impellers, 52, 54 attached to the driveshaft 50, at first and second axial locations, respectively, thereof, within the tank 49. The attrition scrubber 48 also includes a separator disc 68 attached to the driveshaft 50 within the tank 49 at a third axial location thereof, vertically above the axial blades 52, 54. The attrition scrubber 48 additionally includes a pumper impeller 70 connected to the driveshaft 50 at a fourth axial location thereof, within the pump chamber 63.

During operation of the attrition scrubber 48, the first axial impeller 52 up-pumps the slurry while the second impeller 54 down pumps. The separator disc 68 functions to deflect the flow of the two impellers 52, 54. The aforementioned deflection prevents the likelihood of the flow within the attrition scrubber from short circuiting and assists to control slurry residence time within the tank 49. Also during operation, the pump chamber 63 and pumper impeller 70 preferably provide a calm liquid slurry surface within the pump chamber 63 to reduce the likelihood of air entrapment and/or surface splashing. The pump chamber 63, including the pumper impeller 70, also provides positive suction which assists to overcome head losses throughout the attrition scrubber 48. The pump chamber 63, including the pumper impeller 70, further helps to keep the slurry liquid moving through the attrition scrubber 48 while preventing the likelihood for the requirement of elevation changes between stages.

Although an example of the agitation apparatus is shown using a up pumping mixer and attrition scrubber, it will be appreciated that other mixers and attrition scrubbers can be used. Also, although the agitation apparatus is useful to add dry solids to liquids it can also be used to mix other materials together or to condition other types of process streams.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An agitation system for producing a slurry, mixture, or solution from addition of dry solids to a liquid, comprising:

a first tank having a first longitudinal axis, a static liquid level, a dynamic liquid level, and a holdup, wherein the difference between the dynamic liquid level and the static liquid level defines the height of the holdup;

a solid inlet configured to feed dry solids into the first tank;

a first drive shaft disposed in the first tank generally along the first longitudinal axis;

a first impeller attached to the first drive shaft at a first location, wherein the first impeller is configured to pump material in a generally upward direction;

a second tank having a second longitudinal axis, wherein the second tank is in fluid communication with the first tank;

a second drive shaft disposed in the second tank generally along the second longitudinal axis;

a second impeller attached to the second drive shaft at a first location and a third impeller attached to the second drive shaft at a second location, wherein the second impeller is configured to direct flow toward the third impeller, and the third impeller is configured to direct flow toward the second impeller;

a pumper impeller attached to the second drive shaft so that the second impeller is in between the pumper impeller and the third impeller; and a separator disc attached to the second drive shaft in between the pumper impeller and the second impeller.

2. The agitation system of claim 1, further comprising a fourth impeller attached to the first drive shaft at a second location, wherein the fourth impeller is configured to pump material in a generally upward direction.

3. The agitation system of claim 1, further comprising a plurality of baffles disposed in the first tank, wherein the baffles are configured to reduce swirl.

4. The agitation system of claim 1, wherein the impellers are configured to produce a generally axial flow.

5. The agitation system of claim 1, wherein the solid inlet is located above the dynamic liquid level by a height that is at least approximately twice the height of the holdup.

6. The agitation system of claim 1, wherein the static liquid level is approximately 1.2 times the diameter of the first tank.

7. The agitation system of claim 1, wherein the first impeller is operated at speeds up to approximately 350 revolutions per minute.

8. The agitation system of claim 1, wherein the first impeller is operated at speeds up to approximately 60 revolutions per minute.

9. The agitation system of claim 1, wherein the dry solids comprises approximately 35% to 70% of the slurry, mixture or solution.

10. The agitation system of claim 1, wherein the tanks are operated in batch mode.

11. The agitation system of claim 1, wherein the tanks are operated in continuous mode.

12. The agitation system of claim 1, further comprising a plurality of baffles disposed in the second tank, wherein the baffles are configured to reduce swirl in the second tank.

13. The agitation system of claim 1, wherein the second tank includes a pump chamber partially defined by the separator disc, wherein the pump chamber and the pumper impeller provide a calm liquid slurry surface, and positive suction in the second tank.

14. The agitation system of claim 1, wherein the separator disc deflects flow caused by the second and third impellers, so such flow is not substantially directed towards the pumper impeller.

15. A method for addition of dry solids to liquids, comprising:

passing dry solids and liquids into a first tank, wherein the first tank comprises at least a first up pumping impeller;

wetting the dry solids with the liquids in the first tank to form a first mixture, slurry or solution;

passing the first mixture, slurry or solution into a second tank, wherein the second tank comprises a second impeller and a third impeller, wherein the second impeller is configured to direct flow toward the third impeller, and the third impeller is configured to direct flow toward the second impeller and wherein the second tank comprises a pumper impeller attached to the second drive shaft so that the second impeller is in between the pumper impeller and the third impeller and a separator disc attached to the second drive shaft in between the pumper impeller and the second impeller;

generating a high shear zone in the second tanks; and passing the first mixture in the second tank through the high shear zone to form a second mixture, slurry or solution.

16. The method of claim 15, further comprising reducing swirl in the first tank with baffles.

17. The method of claim 15, further comprising reducing swirl in the second tank with baffles.

18. The method of claim 15, further comprising generating generally axial flows with the first second and third impellers.

19. The method of claim 15, further comprising passing the solids into the first tank through a solids inlet that is configured to reduced the likelihood of wetting at the solids inlet.

20. An agitation system for producing a slurry, mixture, or solution from addition of dry solids to a liquid, comprising:

a means for passing dry solids and liquids into a first tank;

a means for generating an up pumping flow pattern in the first tank;

a means for wetting the dry solids with the liquids in the first tank to form a first mixture, slurry or solution;

a means for passing the first mixture, slurry or solution into a second tank;

a means for generating a high shear zone in the second tank;

a means for passing the first mixture, slurry or solution through the high shear zone to form a second mixture, slurry or solution, comprising:

a second tank having a second longitudinal axis, wherein the second tank is in fluid communication with the first tank;

a second drive shaft disposed in the second tank generally along the second longitudinal axis;

a second impeller attached to the second drive shaft at a first location and a third impeller attached to the second drive shaft at a second location, wherein the second impeller is configured to direct flow toward the third impeller, and the third impeller is configured to direct flow toward the second impeller;

a pumper impeller attached to the second drive shaft so that the second impeller is in between the pumper impeller and the third impeller; and a separator disc attached to the second drive shaft in between the pumper impeller and the second impeller.

21. The agitation system of claim 20, further comprising:

a means for reducing swirl in the first tank.

22. The agitation system of claim 20, further comprising:

a means for reducing swirl in the second tank.

* * * * *